US009879960B2

(12) United States Patent
Bergmann

(10) Patent No.: US 9,879,960 B2
(45) Date of Patent: Jan. 30, 2018

(54) SHOTGUN SHELL AUTOMATED WAD DISPENSER ASSEMBLY

(71) Applicant: Patrick K. Bergmann, Covington, LA (US)

(72) Inventor: Patrick K. Bergmann, Covington, LA (US)

(73) Assignee: Patrick K. Bergmann, Covington, LA (US)

( * ) Notice: Subject to any disclaimer, the term of this patent is extended or adjusted under 35 U.S.C. 154(b) by 0 days.

(21) Appl. No.: 15/201,548

(22) Filed: Jul. 4, 2016

(65) Prior Publication Data

US 2016/0313103 A1 Oct. 27, 2016

(51) Int. Cl.
*F42B 33/00* (2006.01)
*F42B 7/08* (2006.01)

(52) U.S. Cl.
CPC ..... *F42B 33/001* (2013.01); *F42B 33/002* (2013.01); *F42B 7/08* (2013.01)

(58) Field of Classification Search
USPC ..... 86/12, 18, 23, 25, 45
See application file for complete search history.

(56) References Cited

U.S. PATENT DOCUMENTS 3,732,774 A * 5/1973 Griffin ..... F42B 33/004 86/23
3,771,411 A * 11/1973 Hazel ..... F42B 33/004 86/24
4,078,472 A * 3/1978 Simpson ..... F42B 33/10 86/23
4,292,877 A * 10/1981 Lee ..... F42B 33/0292 86/23

(Continued)

*Primary Examiner* — John W Eldred

(57) ABSTRACT

The following invention provides method of retrofitting an automated wad dispensing attachment for shotgun shell reloading machines. The invention consist of the following separate parts described from proximal the distal. A cylindrical inclined rotary hopper open in its superior aspect and a floor plate in it inferior aspect having an discharge port opening near its apex of the floor plate. Just above and parallel to the floor plate a motorized rotating collating plate is present which selectively segregates wads into the correct orientation delivering them through the discharge port of the floor plate. A long vertical tubular conduit, the wad feed tube, with a proximal funnel opening attached around the exterior of the discharge port of the floor plate. The wad feed tube is attached via brackets to the reloading machine leading to a common feature on reloading machines—the wad carrier. The wad feed tube serves the purpose of conducting the properly oriented wads to the wad carrier and as a buffer of stacked wads readied for use. As a buildup of wads in the wad feed tube reaches a desired level a switching device is tripped which interrupts the electrical power to the motor actuating the rotating collating plate preventing buffer overflow. Near the distal aspect of the tubular conduit and above the reloading machine wad carrier a metering device is present which serves two purposes. It supports the buffered column of wads and synchronizes single delivery of wad to the reloading machines wad carrier. The wad is then incorporated into the progression of the shotgun shell reloading.

8 Claims, 15 Drawing Sheets

(56) References Cited

U.S. PATENT DOCUMENTS

| | | | | | |
|---|---|---|---|---|---|
| 4,328,735 | A | * | 5/1982 | Allen | F42B 33/04<br>86/23 |
| 5,177,315 | A | * | 1/1993 | Burgess | F42B 33/004<br>86/23 |
| 5,335,578 | A | * | 8/1994 | Lorden | F42B 33/002<br>86/25 |

* cited by examiner

SHOTGUN SHELL AUTOMATED WAD DISPENSER ASSEMBLY

REFERENCES CITED

US Pat. 20040025678A1
U.S. Pat. No. 3,320,848
U.S. Pat. No. 5,335,578
U.S. Pat. No. 3,659,492
US pat. 337117a
CN102128572A
U.S. Pat. No. 3,300,089

CROSS REFERENCE TO RELATED APPLICATIONS

Not Applicable

FEDERALLY SPONSORED RESEARCH

Not Applicable

REFERENCE TO SEQUENCE LISTING, TABLE OR COMPUTER PROGRAM LISTING

Not Applicable

FIELD OF THE INVENTION

The present invention relates to apparatus and methods for fabricating ammunition and, more particularly, to apparatus and methods for loading shotgun shells with shotgun shell wads.

BACKGROUND OF THE INVENTION

The present invention relates to an automated synchronized dispensing mechanism for dispensing shot gun shell wads for loading and reloading of shotgun shells with a single stage or progressive reloading machine.

A favorite activity of many sportsmen relates to utilization of shotgun for hunting or target shooting such as skeet or trap shooting. It is common for participants in the sport to either buy a new shells or load or reload their own. There are a number of reasons why some sportsmen choose to load or reload their own shotgun shells. On a more basic level the act of reloading shotgun shells is found to be pleasurable are relaxing. On the other hand many sportsmen consider financial incentive due to the ever increasing cost of factory loaded shotgun shells as personal loading and reloading is significantly less costly. An additional benefit of personal loading and reloading is the creation of specific cartridges with specific ballistics not available commercially.

The completed shotgun shell consist of a number of components. These are the primer, shot shell hull, propellant charge, wad, and projectile such as lead shot.

There are currently a number of machines available commercially for the purpose of Personal loading and reloading. These range from simple single stage reloading presses in which each phase of the cartridge construction is done individually and manually to the more advanced multi stage progressive reloading presses which result in a completed shotgun shell cartridge with each pull the handle US Pat. 20040025678A1. Some of the more advanced progressive reloading machine forgo many of the manual interaction with the machine such as primer seating U.S. Pat. No. 3,320,848 and shotgun shell hull feeding and positioning some motorized an automated U.S. Pat. No. 5,335,578, U.S. Pat. No. 3,659,492.

A particular phase of the shotgun shell cartridge construction/reloading involves the time consuming and awkward manual placement of the shotgun shell wad into a wad carrier of the reloading machine or into the shotgun shell hull. This repetitive Manual wad positioning can be challenging to some individuals with physical limitations such as rotator cuff injury, carpal tunnel syndrome or arthritis to name but a few. Automating that this stage poses particular problems given the physical nature of the shotgun shell wad. The shotgun shell wads have any near limitless configuration and they are exceedingly light weight as low as 0.04 oz confounding the problem. This challenge has been approached by other inventors as in US pat. 337117a from the 1885-1886 era to more recently CN102128572A and U.S. Pat. No. 3,300,089. Today's invention approaches this challenge from a different direction.

Allowing for the near limitless configuration and appearance as well as size as gauge/caliber features have been identified of the shotgun shell wad that are fairly consistent including a shallow cup like base which serves to focus the explosive charge and provide gas sealing against a shotgun shell barrels, a thinner midsection predominantly for the purpose of providing cushioning from the expanding gas blast to the final component, a deeper cup like component which accepts the shotgun shell projectile such as lead shot. Today's invention takes advantage of these fairly consistent features in nearly all shotgun shell wads.

To accomplish the related and forgoing ends, the invention consists of an mechanism attachment for automatic sorting, metering and synchronized shotgun shell wad feeding to reloading machines described fully and pointed out in the claims. The attached drawings and following detailed description setting forth means for carrying out the invention with several preference variations in which the principle of the invention may be implemented.

BRIEF SUMMARY OF THE INVENTION

A brief summary of today's invention represents an automated synchronized shotgun shell Wad dispensing apparatus for fitting on existing shotgun shell reloading machines. The advantages of the invention include further automating the reloading process and as such a limiting and the manual manipulation of the shotgun shell wads which is both time consuming and cumbersome. The manual manipulation of the shotgun shell wads is one reason why the endeavor of reloading excludes certain individuals with medical conditions such as arthritis etc. today's invention will provide access to this endeavor to many individuals not able to participate. Additionally reloading is it time consuming slow process which will greatly speed up by today's invention. The reloading of shotgun shells has the advantage of decreasing the financial burden of the sport of shotgun shooting. By identifying and exploiting one of the few features shotgun shell wads of multiple vendors have in common and method is outlined to achieve these objectives.

DETAILED DESCRIPTION OF THE INVENTION

Figure 1:
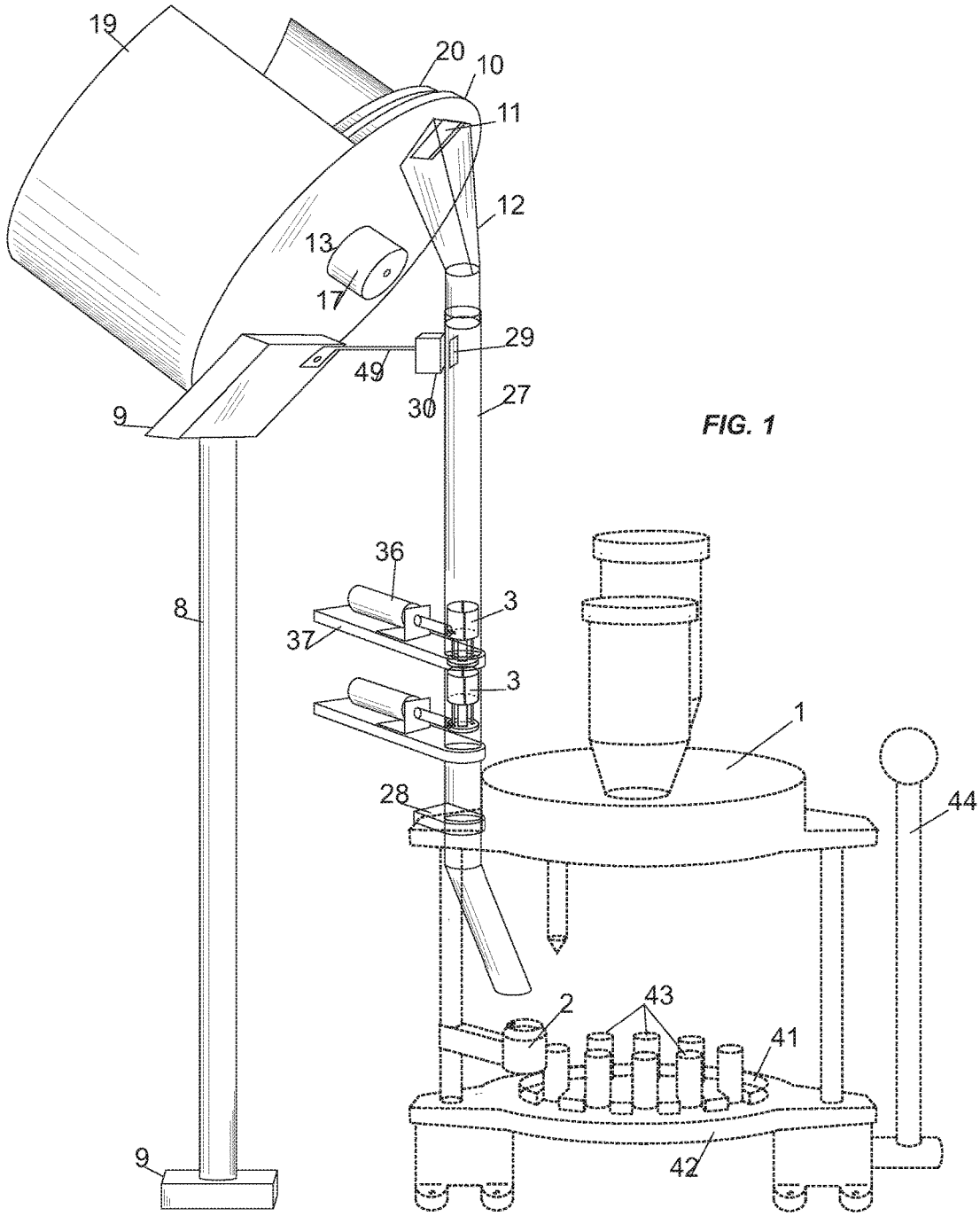
FIG. 1 is a front view of the shotgun shell automated wad dispenser assembly with a hand operated progressive reloading machine shown in dotted outlined adjacent to it.

Turning attention to the drawings, in which similar numbered characters indicate corresponding elements throughout the several views. In FIG. 1 an overall view of the invention and its application to an intended loading/reloading machine (here as refer to as reloading machine) including a elevated rotary hopper FIG. 2 coupled with a funnel like interface made of clear acrylic "funnel interface" 12 to the upper end of the vertical wad feed tube made of clear acrylic "wad feed tube" 27. The vertical wad feed tube 27 contains a selective wad metering device "wad meter" 31 near its midsection and in its lower section either a straight or angled short segment 56 (depending on brand or style of reloading machine and offered by us as a specific kit) to transfer the wad to the reloading machines wad carrier 2. The reloading machine 1 depicted is of the progressive type but the invention equally applies to single stage reloading machine.

Rotary Hopper

Figure 2:
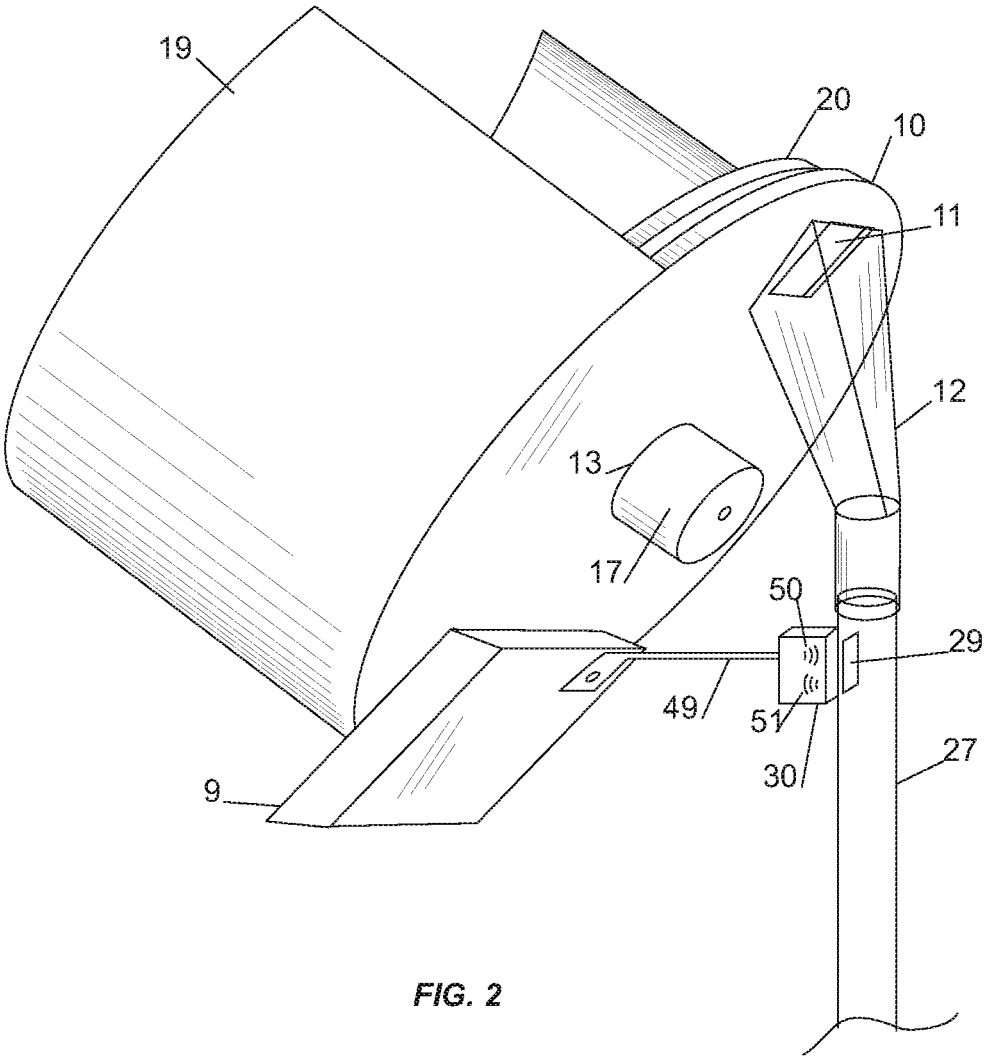
FIG. 2 is a perspective view of a close up of the rotary hopper component of the shotgun shell automated wad dispenser assembly.
Figure 3:
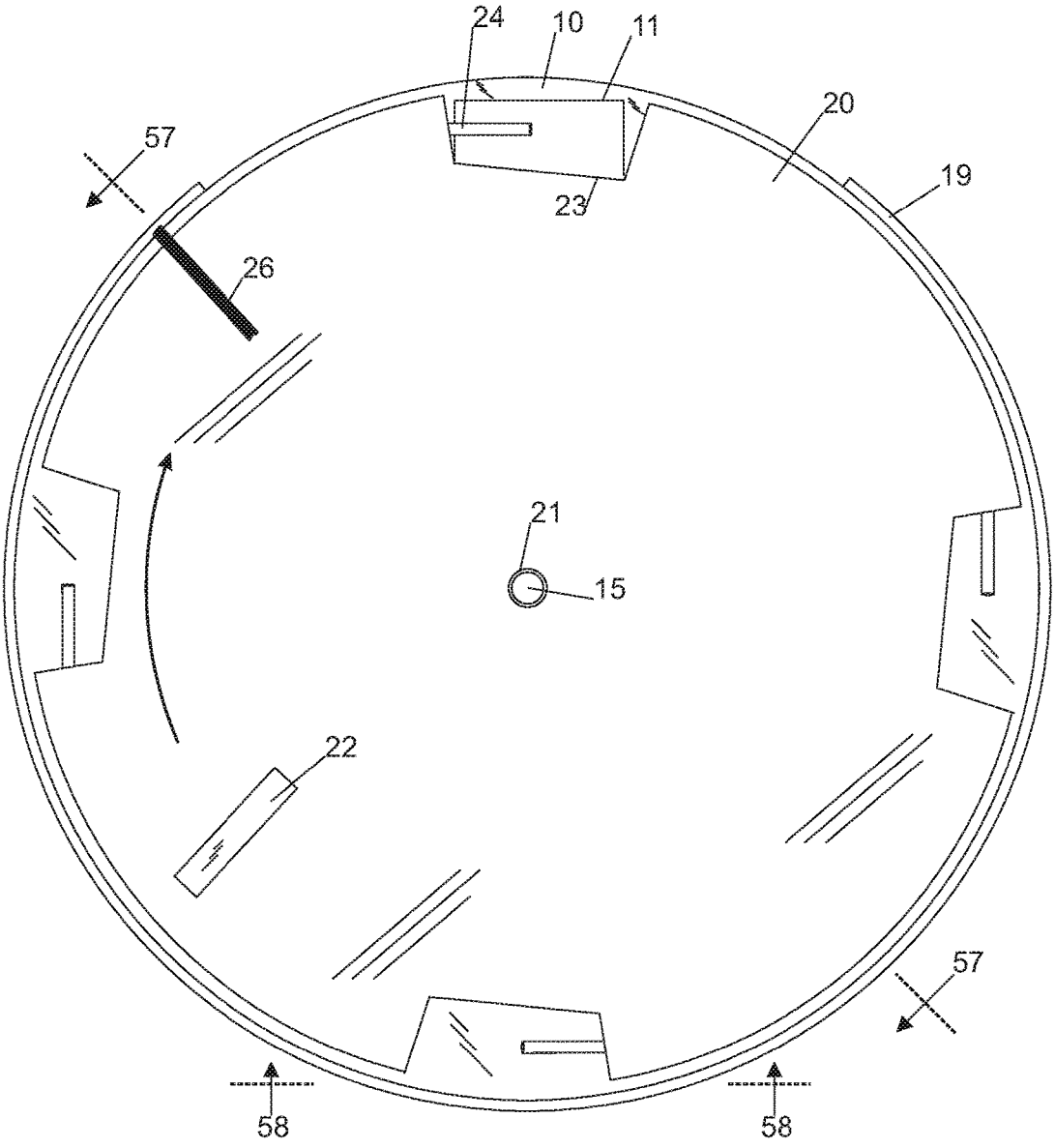
FIG. 3 is a top view of the rotary hopper.
Figure 4:
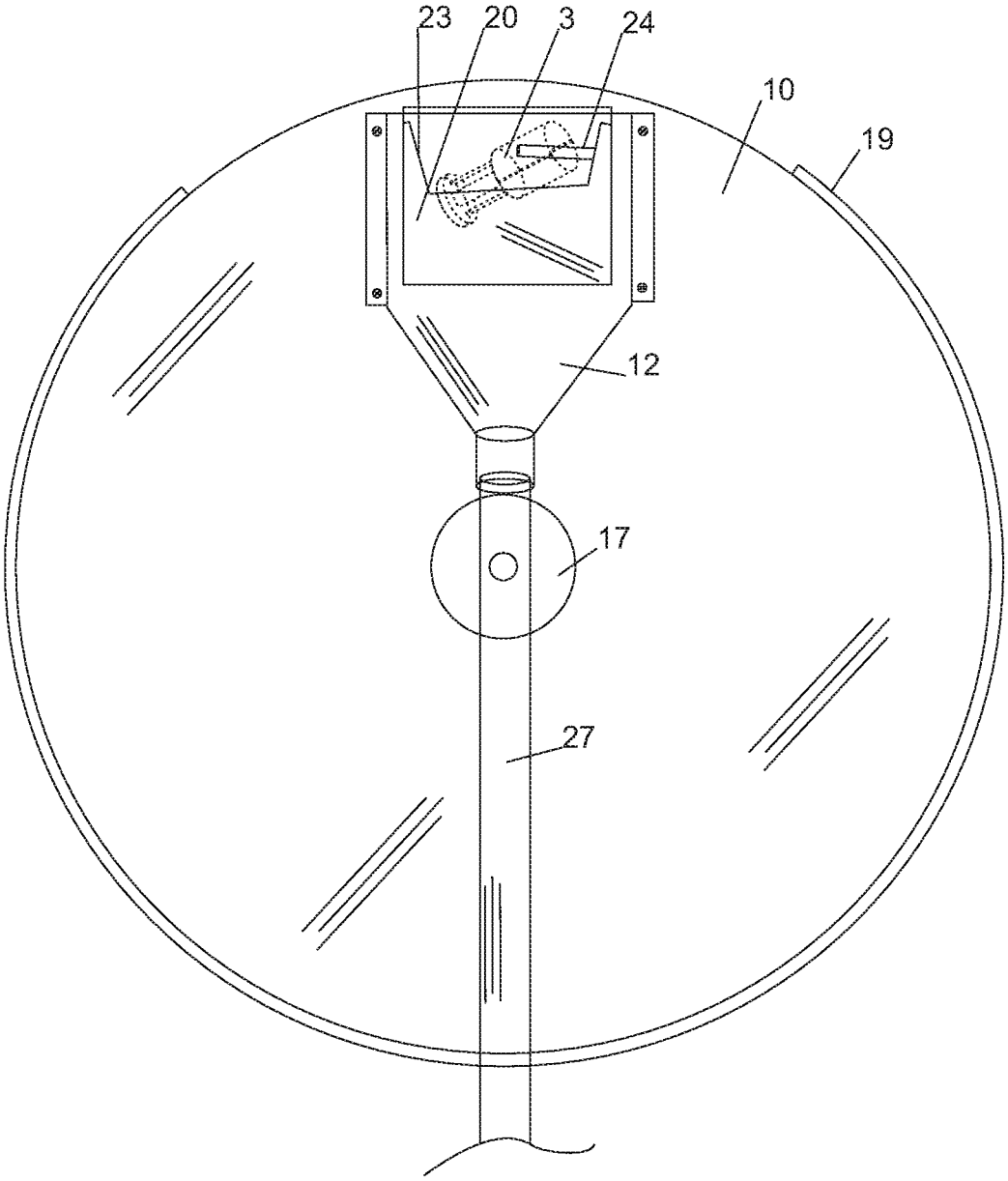
FIG. 4 is a bottom view of the rotary hopper in addition showing a dotted outline wad in the process of exiting the discharge port under gravity having been selected by the cutout chamber and selector bar as it nears the 12:00 position.
Figure 5A:
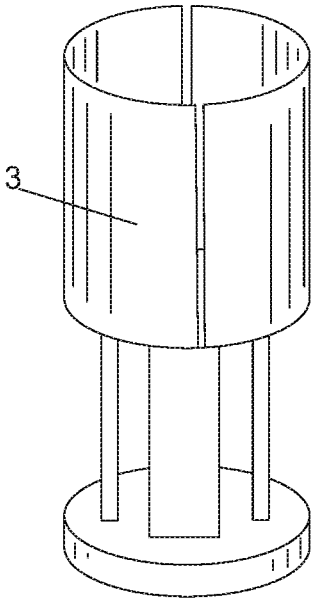
FIG. 5*a* shows overall representation of the intended wad.
Figure 5B:
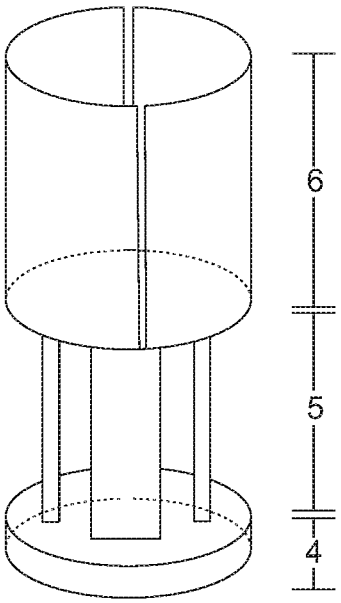
FIG. 5*b* is another view of the intended wad with dotted lines to better depict the identified three constant features of the wad which are utilized to meet the objectives.

The rotary hopper FIG. 2, FIG. 3, FIG. 4 of this invention represents a mechanism to segregate and selectively deliver single sequential wads in the correct orientation via the funnel like interface 12 to the upper end of the wad feed tube 27. The basic structure, material, weight (as low as 0.04 oz) and morphology from different vendors of the wad 3 poses significant challenges to this objective. Today's invention focuses on having identified nearly constant features of the wad construction to overcome these challenges. Specifically FIG. 5*a*, 5*b* near all intended wads 3 contains three segments, the first is a concave shallow base 4 used to focus the expanding charge and provide a degree of gas sealing against the shotgun barrel walls. The wad also contains narrower midsection 5 which can have near limitless variations either spiral, struts, hemispheres, circles etc., which general purpose is to provide a degree of shock absorption to part three. The third portion 6 of the wad in its superior aspect is a deep drawn cup like receptacle (4-10 times depth as compared to part 4) in which projectile such as lead pellets are contained. By taking advantage of these three features of the wad 3 the rotary hopper FIG. 2 overcomes these challenges and meet its objective. The rotary hopper represents of this invention than in a general sense has the utility to deal with delivery of asymmetric products and as such has varied applications although it's described today in relation to reloading machines but as such does not limit the merit of this invention.

The rotary hopper FIGS. 1, 2 is oriented in and inclined attitude and is comprised of multiple components but generally can be viewed as a one side open-ended cylinder elevated and supported above the reloading machine with a vertical rod 8 and bracket 9. At the base a "floor plate" 10 is present which has an opening near its upper 12:00 position, the "discharge port" 11, which interfaces with the funnel like segment 12 described above in addition it contains a centrally located mounting arrangement 13 and clearance hole 21 for the drive shaft 15. The drive shaft 15 which protrudes through the floor plate is the drive mechanism for the rotary collating plate 20 which is parallel to the floor plate 10. The drive shaft 15 is connected to a drive mechanisms such as a motor 17, gear train or belt system that is located external to the hopper. The floor plate 10 also provides attachment to the vertical support member 8 for its correct elevation and predetermined inclination angle. A continuation of the perimeter of the floor plate 10 results in the cylindrical walls 19 of the hopper which may be full circle or semicircle. The rotary collating plate "collating plate" 20 is the mechanism that takes advantage of the three features of the wad 3 to meet the objectives. The collating plate 20 is placed adjacent, inside and parallel to the floor plate 10. At the center of the collating plate it clearance hole 21 is present to interface with the drive shaft 15. In approximate midsection it contains a protrusion 22 of predetermined orientation, shape and location that serves as an agitator for the collection of intended wads in the rotary hopper. At the periphery of the collating plate a number of predetermined cutouts "cutout chamber" 23 in a predetermined shape tailored specifically to the varying caliber and shapes of commercially available wads 3 which are provided by us in varying kits. At one end of the cutout chamber counter the direction of rotation a strut bar or pin "selector bar" 24 is installed predetermined attitude to periphery of collating plate 20 of predetermined length and shape so that wads 3 entering the cutout chamber 23 with the deeper part three 6 of the wad are maintained in the cutout chamber 23 and conveyed to the discharge port 11 of the floor plate and by gravity delivered into the funnel interface 12 with the vertical wad feed tube 27 in the correct orientation for incorporation into the shot shell cartridge 43. Wads 3 which attempt to enter the cutout chamber 23 with the shallower part one 4 of the wad or in any other orientation are then excluded by the shape of the cutout chamber 23 and the selector bar 24 and rejected as the collating plate 20 rotates towards the discharge port 11 of the base plate 10. The rejection of the miss oriented wads is accomplished by gravity and by a rejection mechanism "rejector" 26. Depending on which vendor the end user obtains the wads from we offer different kits comprising the rejector 26 but in a general sense can be described as an interference mechanism to displace the occasional miss oriented wad 3 in the cutout chamber 23 that does not succumb to gravity rejection. This secondary rejection is shown in today's depiction as a coiled spring attached 26 to the rotary hopper at the predetermined angle and location proximal to the discharge port 11 but we offer interchangeable plastic, wood and metal rejection mechanisms attached to the hopper.

Figure 6A:
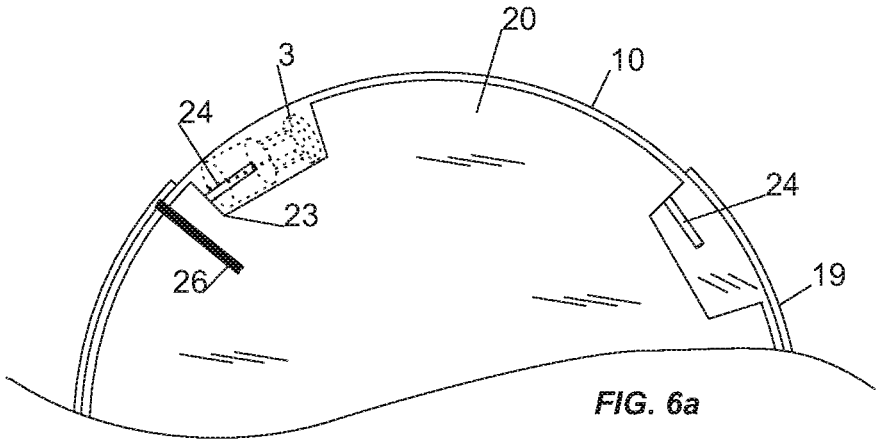
FIG. 6*a* is a partial top view of the upper half of the rotary hopper showing a dotted outline wad having been selected in the correct orientation by the cutout chamber and selector bar as the collating plate rotates clockwise.
Figure 6B:
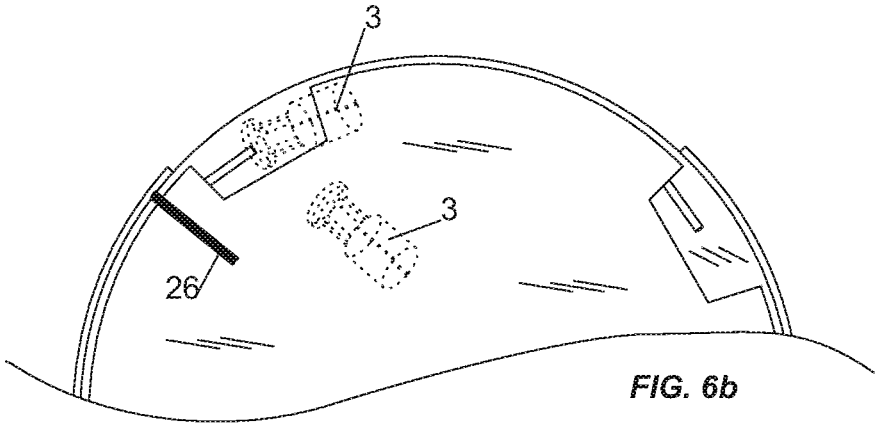
FIG. 6*b* is a partial top view of the upper half of the rotary hopper showing a dotted outline wads that have partially entered the cutout chamber in the wrong orientation and are prevented from being retained in the cutout chamber by the selector bar which are then rejected by gravity or the rejector.
Figure 6C:
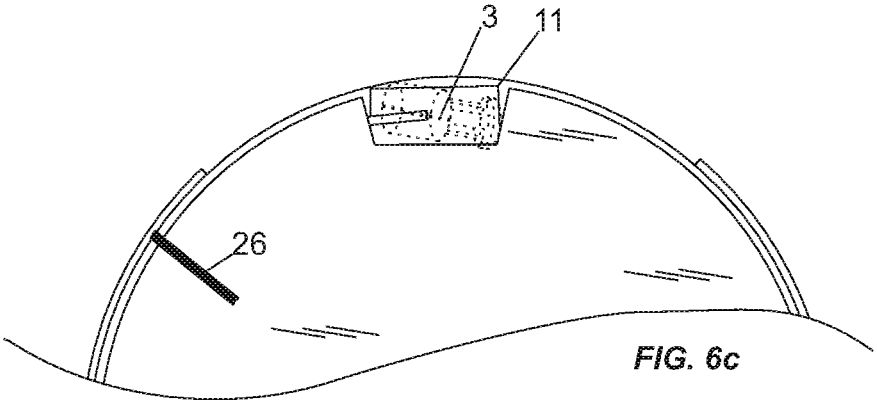
FIG. 6*c* is a partial top view of the upper half of the rotary hopper showing a dotted outline wad in the process of exiting the rotary hopper discharge port under gravity.
Figure 7A:
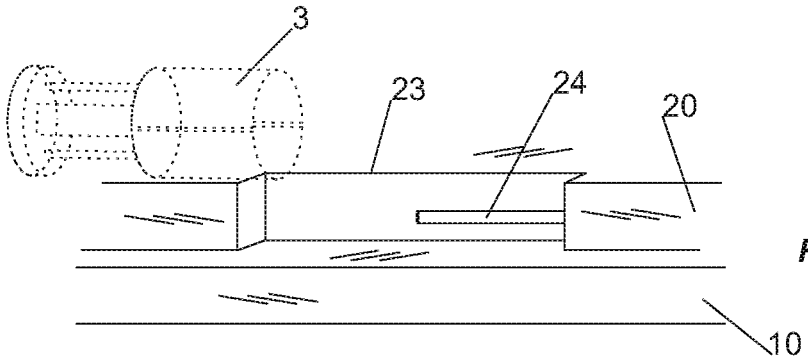
FIG. 7*a* is a sectional detail on line 58-58 of FIG. 3 showing a dotted outline wad approaching the cutout chamber as the collating plate rotates clockwise.
Figure 7B:
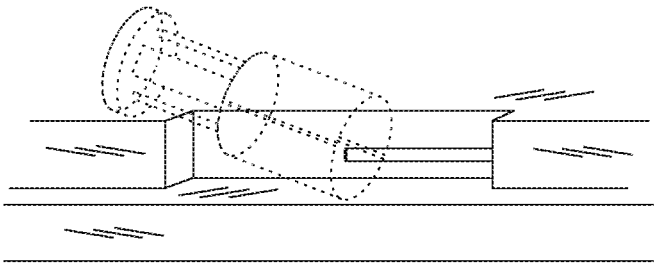
FIG. 7*b* is a sectional detail on line 58-58 of FIG. 3 showing a dotted outline wad as it enters the cutout chamber as the collating plate rotates clockwise.
Figure 7C:
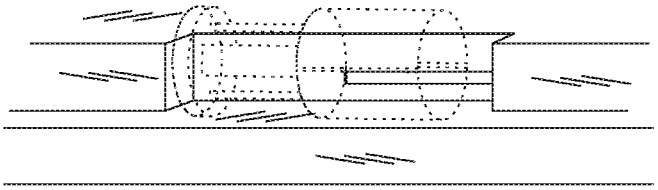
FIG. 7*c* is a sectional detail on line 58-58 of FIG. 3 showing a dotted outline wad having been allowed by the selector bar to be fully seated in cutout chamber in the correct orientation as the collating plate rotates clockwise.
Figure 7D:
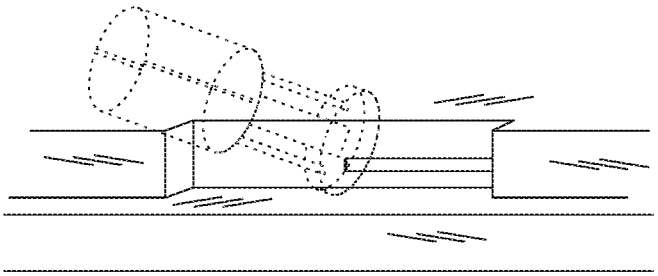
FIG. 7*d* is a sectional detail on line 58-58 of FIG. 3 showing a dotted outline wad in the incorrect orientation prevented from fully seating in the cutout chamber by the selector bar interacting with the shallow segment of the wad as the collating plate rotates clockwise.
Figure 7E:
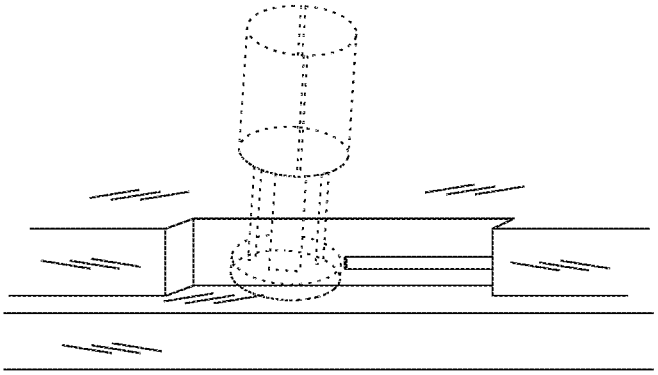
FIG. 7*e* is a sectional detail on line 58-58 of FIG. 3 showing a dotted outline wad in the incorrect orientation prevented from seating in the cutout chamber by the selector bar interacting with the miss oriented wad as the collating plate rotates clockwise.

The function of the cutout chamber 23 and selector bar 24 now in more detail. In FIG. 7*a* a single dotted outlined wad 3 is shown although it's understood that a collection of adjacent wads 3 are present, the one depicted as seen approaching the cutout chamber 23 with is deeper cup like segment 6 as if the collating plate 20 rotates clockwise. FIG. 7*b* shows further progression of the clockwise rotation of the collating plate 20 allowing the wad to teeter in to the cutout chamber 23 and the selector bar 24 entering the cup like segment 6. FIG. 7*c* shows further progression by clockwise rotation of the collating plate 20 now allowing the wad to be fully seated and selected in the correct orientation within the cutout chamber 23 and will be retained their with the help of the selector bar 24 until discharge at the discharge port 11 of the floor plate as shown in FIG. 4 and FIG. 6*c*. FIG. 6*a* shows alternate top view of the dotted outline wad 3 fully seated nearing the discharge port 11 of the floor plate 10. FIG. 7*d* shows a miss oriented wad attempting to enter the cutout chamber 23 with it shallower segment 4 with the selector bar 24 preventing seating inside the cutout chamber 23 as the collating plate rotate clockwise gravity or the rejector 26 and return it to the pile of wads at the base of the rotary hopper. FIG. 6*b* shows an alternate top view of dotted outline wads 3 as the collating plate 20 rotates clockwise and gravity or the rejector act on wads to clear interference with function. FIG. 7*e* is an alternate view of miss oriented wad as in FIG. 7*d* and will be acted upon similarly.

Wad Feed Tube.

The wad feed tube 27 represents a conveyance mechanism to deliver via gravity correctly oriented wads 3 from the rotary hopper FIG. 2 to the reloading machine wad carrier 2. The wad feed tube 27 has three predominant main functions. In addition to providing a conveyance mechanism the wad feed tube also serves as a buffer/reservoir 54 of stacked wads ready for delivery as well as an interface with the wad meter mechanism 31 near the mid section and in it lower aspect 56 an interface for delivery of the wad to the reloading machine wad carrier. The wad feed tube represents a tubular predominantly vertically oriented structure which can be attached via brackets 28 to the rotary hopper and reloading machine. In its upper aspect a funnel like interface 12 is present to interact with the rotary hopper discharge port 11 and immediately inferior a cutout clearance 29 is present for the buffer reservoir switch 30. In its middle to lower section an area is reserved for the wad meter 31 and the created selector chamber 55. The critical component is also present in it inferior most segment 56 which provides the crucial synchronized delivery of a single correctly oriented wad 3 to the reloading machine wad carrier 2. The illustration shows to meet this objective and to apply this invention to the more popular or common reloading machine the lower most segment 56 is angled in a predetermined attitude and terminated in a predetermined shape to take advantage of the wads construction characteristics and ricochet angle to deliver the wad via gravity to the reloading machines wad carrier 2 without requiring modification of the reloading machine. The wad 3 is delivered via gravity into the reloading machines wad carrier 2 with above implementations so that the wad comes to rest in the wad carrier 2 in the correct orientation location and timing without bouncing out or miss guiding into the reloading machine wad carrier. The implementation is such that the error rate is nearly absent in the units provided with the rare error mostly related to deformity of the commercial wad also a rare occurrence. Other less common or older reloading machines lend themselves to a straight walled feed tube with or without terminal modifications of the feed tube and some with or without modifications of the reloading machine wad carrier 2.

Wad Meter.

The wad meter 31 is the mechanism of which synchronizes the delivery of the correctly oriented wads 3 such that a single wad is selected from the growing column of wads in the feed tube section serving as a reservoir 54. The wad meter delivers the single selected wad 3 at the critical time in the reloading machine cycle to the reloading machine wad carrier 2 and is then incorporated into the progressive construction of the shotgun shell cartridge 43. The previously described characteristics and variations of the wad pose significant challenges to this objective, however, the previously described the identified fairly constant features of the wad are taken advantage again to overcome this challenge. In a general sense the wad meter 31 provides alternating synchronized bias in conjunction with gravity forces to the column of wads in the reservoir section 54 of the wad feed tube 27. The wad meter has a number of components. First it has two mechanisms to apply bias to the wads "primary wad bias component 34, secondary wad bias component 35" between them creates the "selector chamber" 55. The wad bias components may be powered mechanically FIG. 10 or electro-mechanically FIG. 8 that is some reloading machines are better suited for one of the other powered mechanism. In FIGS. 8, 9*a-e* the more common implementation is shown with two pull type solenoids 36. The solenoids 36 are mounted in line superior—primary wad bias component 34 and inferior—secondary wad bias component 35 on the wad feed tube midsection with split clamp brackets 37 at predetermined location and separation. The bias from the solenoids 36 is applied to the wad via a reduced diameter member 38 located coaxially at the free end of the solenoid driving rod 39 the via a clearance hole 40 in the wall of the wad feed tube 27. The reduced diameter member 38 may need to be a reduced diameter rod or blade like extension of the solenoid 36 depending on brand of wad but one of the advantages of this design an easy variation to implement. The more common or popular style of reloading machine 1 possesses a rotating shell plate 41 and shell plate carrier 42 on which the shotgun shell hulls 43 are located which reciprocates vertically with each pull of the handle 44 and also rotates as it progresses to the next station in the phases of shot shell cartridge assembly. It is that this vertical reciprocating action of the reloading machine 1 which is taken advantage to overcome the challenges and meet the objectives of the wad meter 31.

Figure 11A:
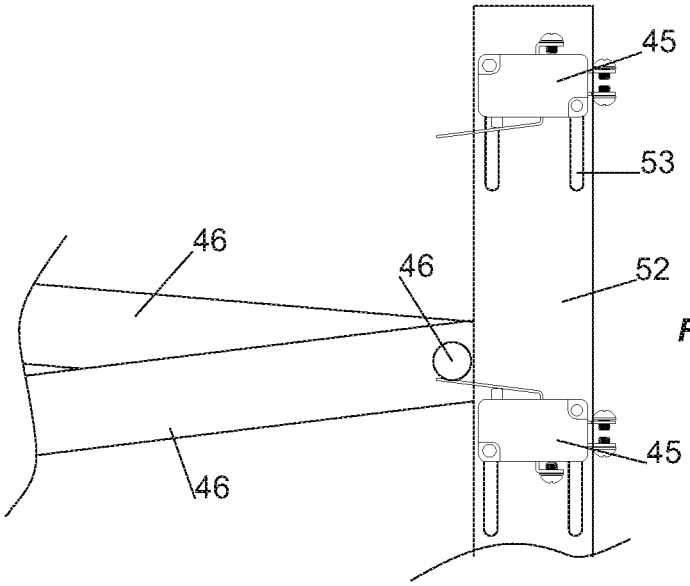
FIG. 11*a* is a side and partial view of the detail of the timing switches for the electromechanical wad meter interacting with the reloading machine linkages in the approximate resting state of reloading machine.
Figure 11B:
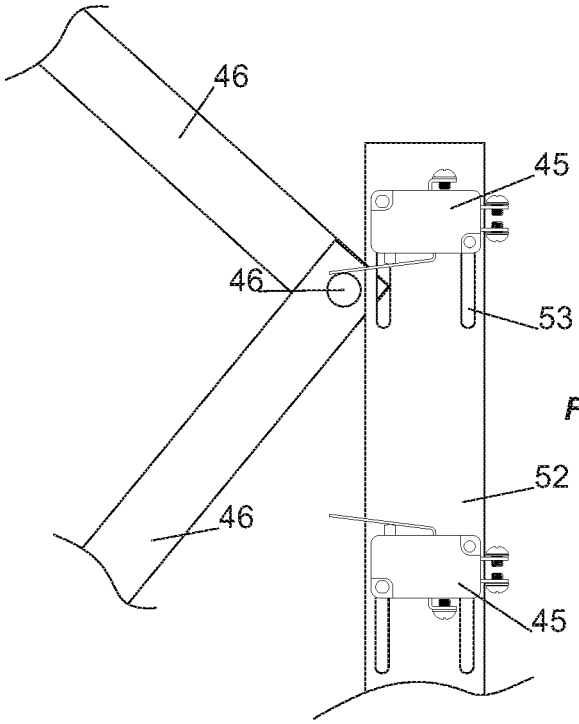
FIG. 11*b* is a side and partial view of the detail of the timing switches for the electromechanical wad meter interacting with the reloading machine linkages in the approximate mid cycle of reloading machine.
Figure 15A:
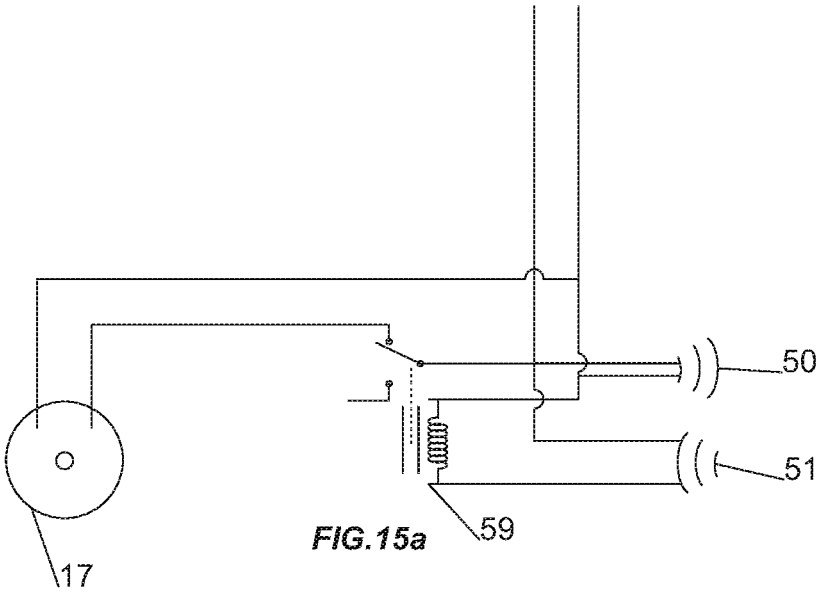
FIG. 15*a* is an electrical wiring diagram for the switching mechanism preventing buffer overrun of the gathering column of wads in the wad feed tube in this diagram depicted by transmitter, receiver, relay and motor.
Figure 15B:
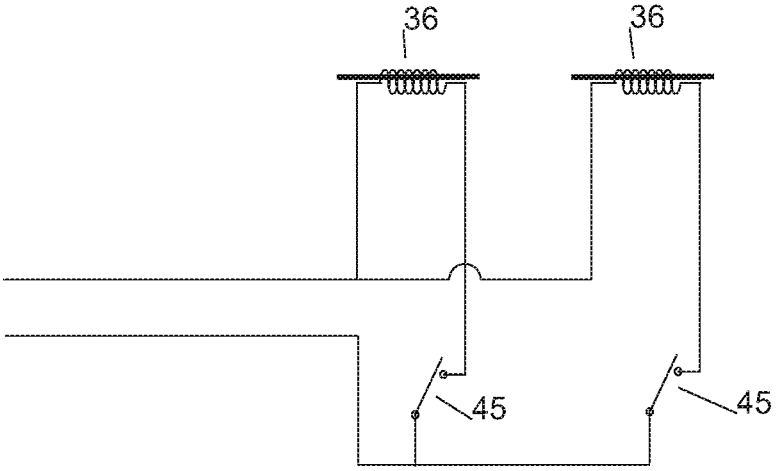
FIG. 15*b* is an electrical wiring diagram for the timing switching mechanism for the electromechanical wad meter depicting snap acting switches and solenoids.

The more common variety of reloading machine 1 lends itself to the implementation of snap acting switches 45 shown in FIG. 11*a-b* and electrical diagram FIG. 15*b* or proximity switches triggered by the position of the shell plate carrier or driving components such as the handle or linkages 46 to synchronize the selection of a single wad 3 by the primary wad bias component 34 from the reservoir column 54 and isolate the wad to the selector chamber 55 to be acted on by the secondary wad bias component 35 who's actuation is triggered at the critical time to be delivered to the reloading machines wad carrier 2 via gravity accomplishing the objective of delivering a single correctly oriented wad in a synchronized fashion for incorporation into the construction of the shot shell cartridge. FIG. 11*a-b* show the snap acting switches mounted on bracket 52 which exact timing of the switches can be adjusted by the mounting slots 53 on the bracket 52. In a less common variety of reloading machine the primary and secondary bias component a required for represent a spring actuated member 47 which is powered and it's a trigger timed mechanically by a cam like a mechanism 48 derived from an interfacing members directly to the shell plate carrier 42 or components an additional advantage of this invention allowing implementation to all known reloading machine variants items familiar to those well versed in the art.

In more detail with the reloading machine 1 in its resting state the wad feed tube is shown with a filled reservoir 54 of wads above the primary wad bias component and an empty selector chamber 55 between the wad bias components. The primary wad bias component 34 applying bias to the midsection 5 of the bottom most wad in the column preventing progression or interference with the empty selector chamber 55. As the reloading machine is actuated by the handle 44 or motorized drive mechanism the shell plate carrier 42 travels vertically and via described interface with switching mechanism FIG. 11*a-b* activates the primary wad bias component 34 removing bias through the clearance opening 40 of the wad feed tube 27 from the inferior most wad of the gathered column and the entire wad column descends and a single wad 3 enters the selector chamber 55 and is prevented further progression by gravity by the secondary wad bias component 35 interference from applied bias to the feed tube 27 through the clearance opening 40. The second wad 3 in the column is now optimally positioned for interaction and retention by the primary wad bias component 34. As the reloading machine nearing its mid cycle it triggers the switch mechanism FIG. 11*b* which to reapply is bias from the primary wad bias component 34 near the midsection 5 of the wad 3 preventing further movement by gravity this results in an isolated single wad 3 in the selector chamber 55 itself prevented from further motion by the bias supplied by the secondary wad bias component 35. As the user further applies motion to the reloading machine handle or drive mechanism the reloading machine shell plate carrier 42 begins to travel down vertically to return to its resting position this among many results in two specific actions the reloading machine wad carrier 2 swings out of battery into its resting position underneath the terminal segment 56 of the bullet feed tube 27 and triggers the switching mechanism FIG. 11*a* actuates the secondary wad bias component 35 removing interference from the base of the wad in if the selector chamber 55 allowing gravity to act and deliver a single wad at the critical time in to the wad carrier 2 then as the user actuates the second cycle of the reloading machine 1 the wad carrier 2 swings in to battery allowing incorporation of the just the delivered wad into the shotgun shell cartridge 43 and the cycle repeats. It is this alternating application of bias that allows meeting one of the objectives of this invention.

The following describes the wad meter function in more detail and it is understood that it's function in relation to the phases of the reloading machine as described, only one is critical that being the timing of release of the wad nearing the end of the cycle the remainder of the timing shows one of the objectives of this invention by allowing variability in location of the timing switches FIG. 11*a* and FIG. 11*b* to overcome interference by the variation of different reloading machines.

Figure 8:
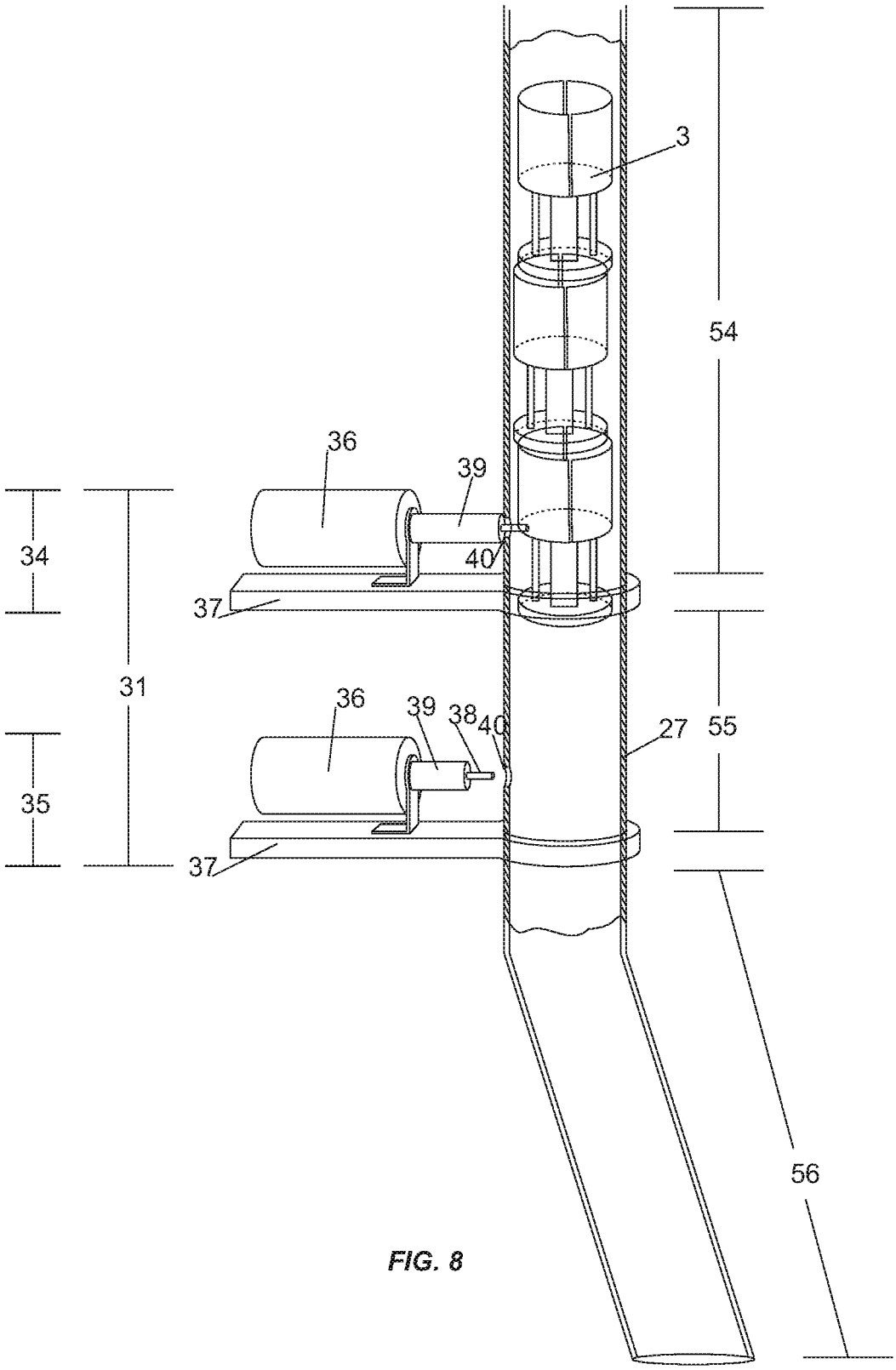
FIG. 8 is a close up side and partial cutout view of the wad feed tube and electromechanical wad meter in addition showing the three generals segments of the wad feed tube as well as a column of gathering wads from the rotary hopper.
Figures 9A, 9B, 9C, 9D, 9E:
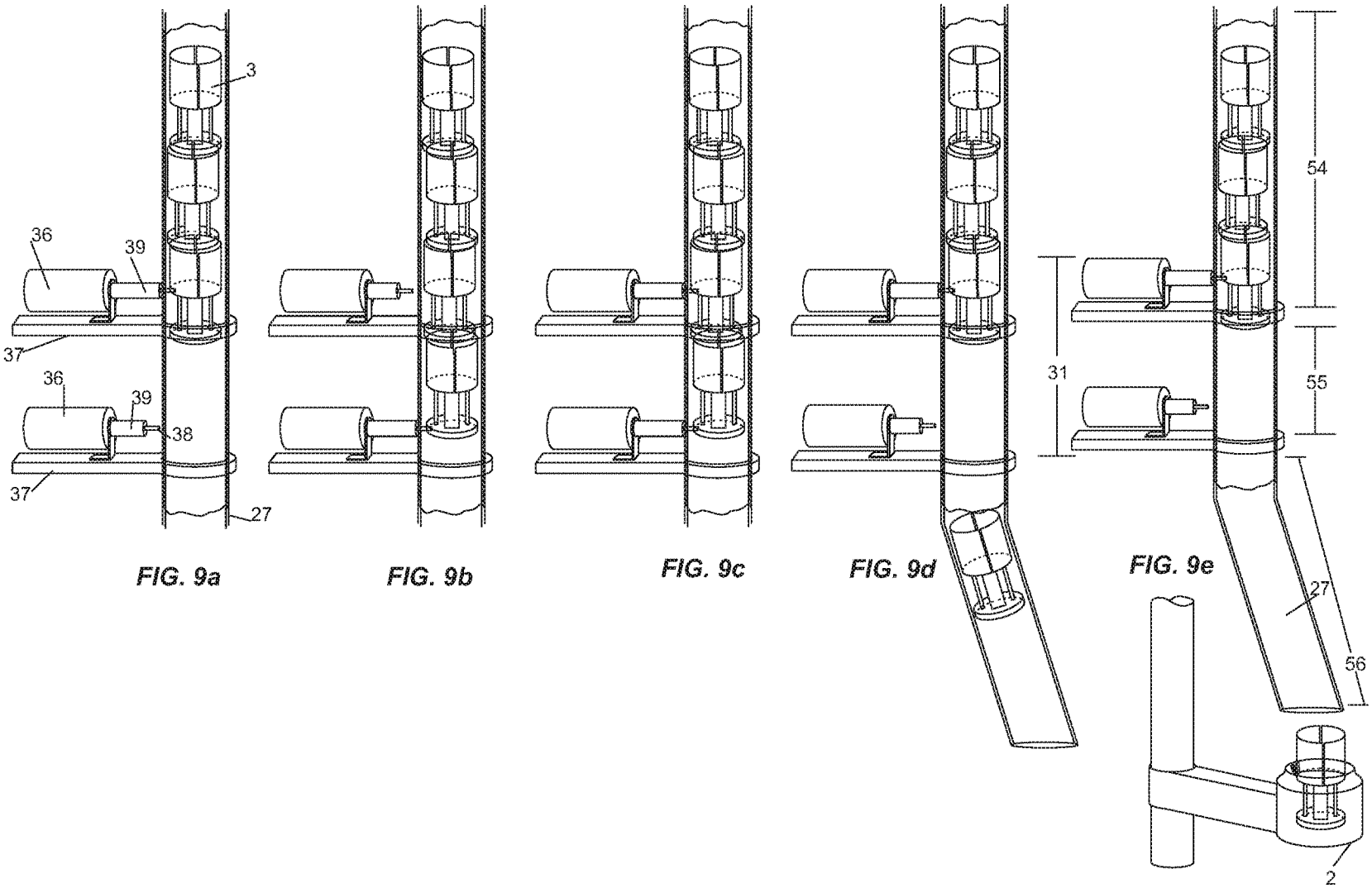
FIG. 9*a* is a side view of the wad meter and partial and cutout view of the wad feed tube and it function in the approximate resting state of the reloading machine.
FIG. 9*b* is a side view of the wad meter and partial and cutout view of the wad feed tube and it function in the approximate mid cycle of the reloading machine as it triggers switching allowing column of wads to descend.
FIG. 9*c* is a side view of the wad meter and partial and cutout view of the wad feed tube and it function in the approximate ⅝ cycle of the reloading machine releasing trigger switch causing selection of single wad in selector chamber.
FIG. 9*d* is a side view of the wad meter and partial and cutout view of the wad feed tube and it function in the approximate 9/10 cycle of the reloading machine as it triggers switching and releasing the single selected wad.
FIG. 9*e* is a side view of the wad meter and partial and cutout view of the wad feed tube and it function in the approximate resting state of the reloading machine also showing the wad having been delivered to the reloading machine wad carrier.

FIG. 9*a* and FIG. 8 shows approximate resting state of the reloading machine as in FIG. 1 at this stage the primary wad bias component 34 is seen applying bias to the column of wads preventing downward movement to fill the empty selector chamber 55. FIG. 9*b* shows the reloading machine in the approximate mid cycle as it triggers upper timing switch FIG. 11*b* removing bias by the primary wad bias component 34 allowing column of wads to descend and having released the lower timing switch the application of bias by the secondary wad bias component 35 preventing further downward progression of the wad column and as such filling the selector chamber 55 with a single wad. FIG. 9*c* shows the reloading machine in the approximate ⅝ cycle releasing the upper trigger switch 45 the upper primary wad bias component 34 now applying bias to the second wad in the column resulting in selection of single wad in selector chamber. FIG. 9*d* shows the reloading machine in the approximate 9/10 cycle as it triggers the lower timing switch 45 and releasing the single selected wad. FIG. 9*e* shows the reloading machine in the approximate resting state also showing the wad having been delivered to the reloading machine wad carrier 2.

Figure 12C:
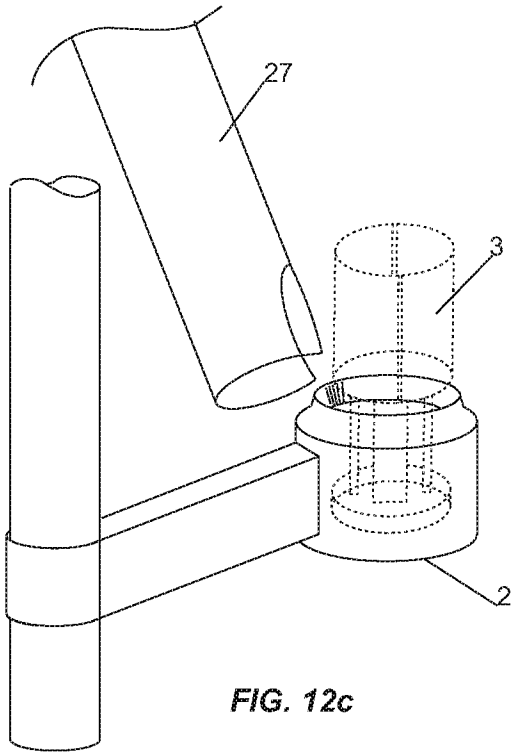
FIG. 12*c* is a close up front partial view of the swing out type wad carrier of the reloading machine and distal segment wad feed with the reloading machine motion bringing the wad carrier into battery.
Figure 12B:
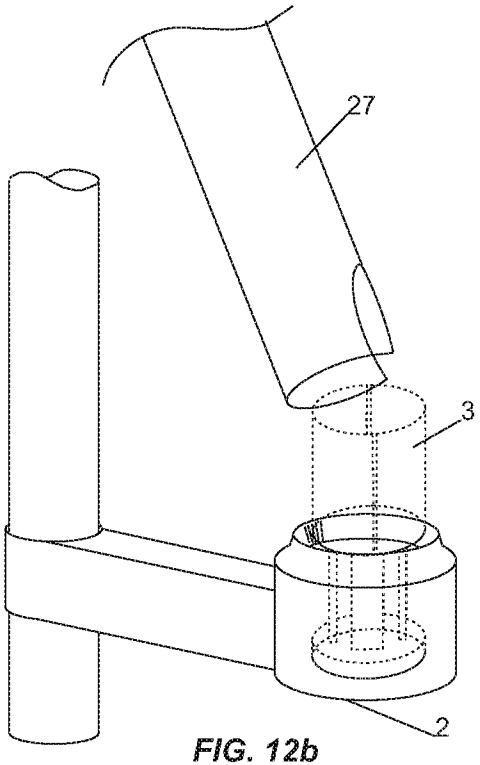
FIG. 12*b* is a close up front partial view of the swing out type wad carrier of the reloading machine and distal segment wad feed tube with a wad having been released by the wad meter now delivered into the resting state wad carrier.
Figure 12A:
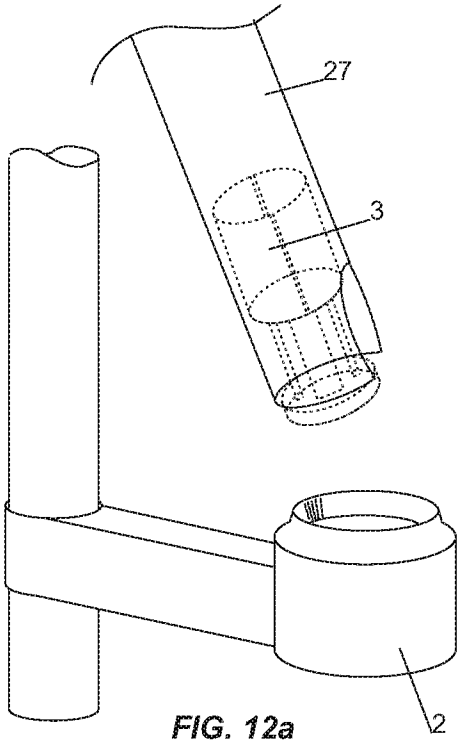
FIG. 12*a* is a close up front partial view of the swing out type wad carrier of the reloading machine and distal segment wad feed tube with a wad having been released by the wad meter nearing delivery into the resting state wad carrier.

FIG. 12*a* is a close up of the swing out type wad carrier 2 of the reloading machine in similar stage as FIG. 9*d* with a wad having been released by the secondary wad bias component 35 with wad nearing delivery into the resting state wad carrier 2. FIG. 12*b* is a close of the swing out type wad carrier of the reloading machine with a wad now delivered into the resting state wad carrier. FIG. 12*c* is a close up of the swing out type wad carrier of the reloading machine with the reloading machine starting the second cycle causing motion bringing the wad carrier into battery and ready for incorporation into the shot shell hull 43.

Figures 14A, 14B, 14C:
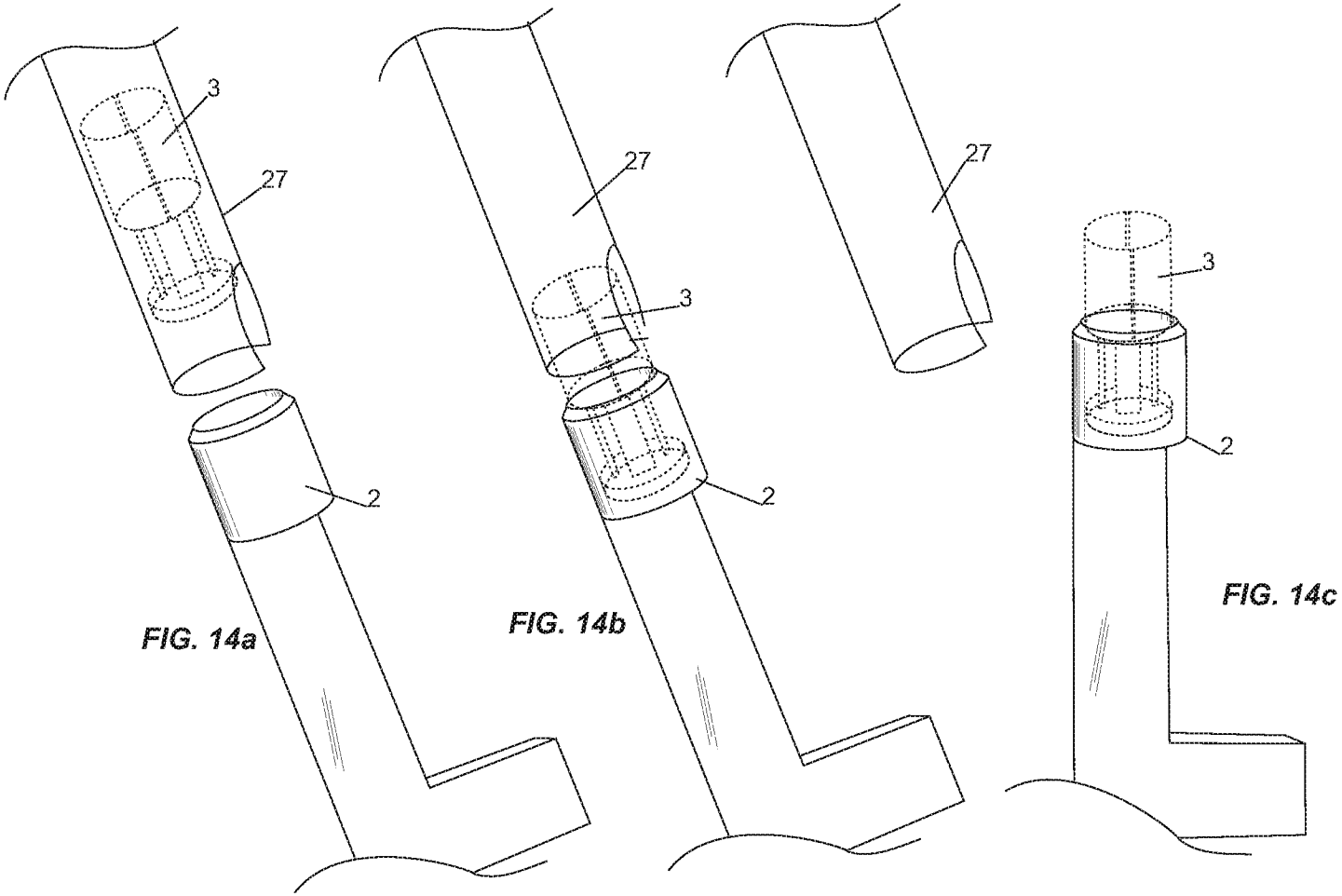
FIG. 14*a* is a close up front partial view of Dillon Precision Products tilt out type wad carrier of the reloading machine and distal segment wad feed tube with a wad having been released by the wad meter nearing delivery into the resting state wad carrier showing one objective of invention, its applicability to all known reloading machines.
FIG. 14*b* is a close up front partial view of Dillon Precision Products tilt out type wad carrier of the reloading machine and distal segment wad feed tube with a wad having been released by the wad meter now delivered into the resting state wad carrier.
FIG. 14*c* is a close up front partial view of the Dillon Precision Products tilt out type wad carrier of the reloading machine and distal segment wad feed with the wad carrier in battery.

One of the objectives of this invention is its versatility of being able to apply to all known reloading machines to meet this objective FIG. 14*a-c* show the popular Dillon Precision Products tilt out type wad carrier 2 in similar function to FIG. 12*a-c* in keeping with the main function of providing synchronized delivery of single correctly oriented wad to the wad carrier 2 at the core of this invention.

Figure 10:
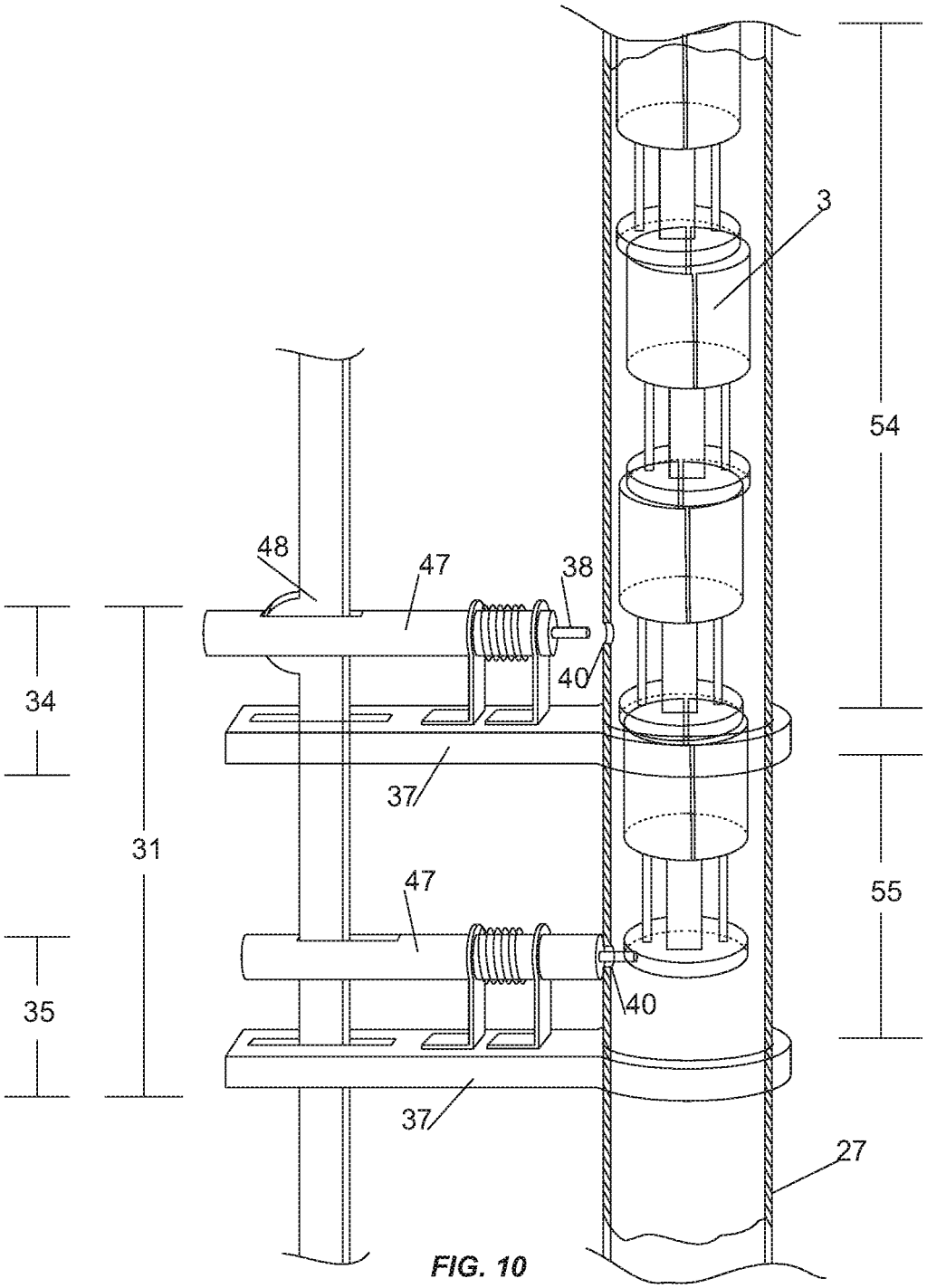
FIG. 10 at the essence of the invention is application of bias by the wad meter therefore present a side view of the alternative configuration with a mechanical wad meter and partial and cutout view of the wad feed tube in the approximate mid cycle of the reloading machine.

One of the objectives of this invention is its versatility of being able to apply to all known reloading machines to meet this objective FIG. 10 shows the alternative mechanical wad bias components from spring loaded member 47 acted upon by cam like a action by 48 which is attached to a portion of the vertical oscillating component such as the shell plate carrier 42 of the reloading machine near its mid cycle similar to FIG. 9*b* in keeping with the main function of providing synchronized alternating bias to the column of wads at the core of this invention.

Rejector.

Figure 13:
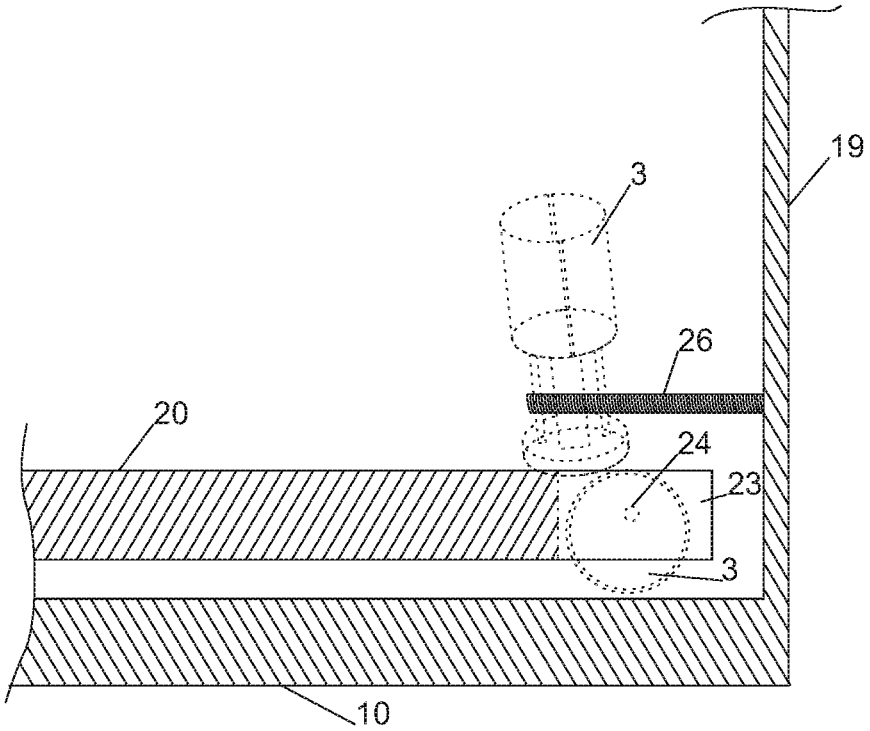
FIG. 13 is a sectional detail on line 57-57 of FIG. 3 showing the rejector mechanism with one correctly oriented wad in the cutout chamber and a piggybacked miss oriented wad acted upon and rejected by the rejector mechanism.

Returning attention to the rotary hopper FIG. 2. As previously described the handling of the wads pose a significant problems given their nature. Today's invention addresses this objective with the collating plate 20, cut out chamber 23 and selector bar 24 in near completeness. Allowing for manufacturing deformities of the wads etc. occasionally a double stack or piggyback etc. wads that do not succumb to gravity for rejection from the cutout chamber these are dealt with the rejection device 26 as shown in FIG. 13. The rejection device essentially represents interference to dislodge the offending wad 3 prior to reaching the discharge port 11 of the rotary hopper. In FIG. 13 a spring 26 which is attached to the rotary hopper provides interference in dislodging the offending wad not succumbing to gravity rejection.

Buffer Reservoir Switch.

As previously mentioned one of the functions of the one feed tube is to provide a buffer/reservoir 54 of wads in a form of a stacking column above that the primary wad bias component 34 such that a readied supply of wads can be continuously provided to the reloading machine 1. In order to avoid buffer overrun is switching mechanism 30 is implemented near the upper end of the wad feed tube as seen in FIG. 2. As mentioned the intrinsic characteristics of the wad particularly its lightweight construction poses significant challenges to the objective. Today's invention overcomes these challenges with an optical switching mechanism 30. Mounted via bracket 49 to the rotary hopper an optical emitter 50 and an optical receiver 51 interface with a wad feed tube 27 via a clearance slot 29 near the upper end of the wad feed tube 27 which is coupled to a relay switch 59 which interrupts power to the driving a mechanism 17 to the drive shaft 15 of the collating plate 20. As the growing column of wads in the wad feed tube reservoir 54 nears overrun it interrupts the light path of the sensors and triggers the relay 59 shutting off the motor 17 until which time the buffer of wads in the reservoir 54 decreases and actuates the motor 17 driving the collating plate 20. The FIG. 15*a* shows the electrical diagram of the buffer reservoir switch apparatus. The switching function can be performed by a less reliable snap acting switch which is also difficult to source from vendors due to is extremely low trigger force so that it does not bind the wads in the wad feed tube and disrupt function.

I claim:

1. A automated shotgun shell wad dispensing assembly to work in combination with shotgun shell reloading machine and multiple shotgun shell wads to dispense successive single shotgun shell wad to the said shotgun shell reloading machine comprised of:

(a) A base in horizontal orientation, (b) An upright standard in vertical orientation with a lower end and upper end, (c) Said upright standard said lower end mounted to said base, (d) A hopper for receiving said shotgun shell wad, (e) Said shotgun shell wad from here on referred to as wad, (f) Said hopper defined as a cylinder with one open end, one closed end, cylinder wall, and cylinder axis, (g) Said closed end and said cylinder wall are made of solid material, (h) Said hopper said open end oriented above said hopper said closed end, (i) Said hopper defined as a cylinder with inside bounded by the said open end, said closed end and said cylinder wall, (j) Said hopper defined as a cylinder with space defined as outside external to said inside, (k) Said hopper for receiving multiple said wad into said inside, (l) Said hopper mounted on said upper end of said upright standard to said outside of said hopper said closed end in an inclined relation making an obtuse angle between said hopper said closed end and said vertical orientation of said upright standard, (m) Said hopper said closed end having a discharge opening for conveyance of said wad from said hopper said inside to said hopper said outside, (n) Said hopper closed end has a superior most point defined as 12 o'clock as viewed from above, (o) Said discharge opening located at said 12 o'clock position on said hopper said closed end and, (p) Said discharge opening located at the junction of the said hopper said closed end and said hopper said cylinder wall.

2. A automated shotgun shell wad dispensing assembly as defined in claim 1, which includes:

(a) A collating plate is present, (b) Said collating plate comprising a plate inside said hopper disposed adjacent and parallel to said hopper closed end, (c) Said collating plate has a margin along its circumference, (d) Gear reduction motor and electrical power supply are present, (e) Said gear reduction motor attached on said outside of said hopper to said hopper said closed end, (f) Said hopper said closed end has a central located clearance hole, (g) Said gear reduction motor has drive shaft entering said hopper said inside through said hopper said central located clearance hole, (h) Said collating plate has a central attachment point, (i) Said drive shaft attached to said collating plate at said central attachment point, (j) Said collating plate has rotation about said hopper said cylinder axis by means of said gear reduction motor, (k) Said collating plate having cutout as an aperture for receiving a single said wad, (l) Said collating plate has said rotation in clock wise direction as viewed from above, (m) Said clock wise direction defines said cutout as having a leading edge and a trailing edge, (n) Multiple said cutout are present, (o) Said cutout are angularly spaced and located along said collating plate said margin, (p) Each and every said wad are further defined with inherent features to include a base end of first depth and a cup end of second depth greater than the said base end of said first depth, (q) Said wad taken up in said cutout said cup end up orientation comprise correct orientation, (r) Said wad taken up in said cutout other than said cup end up orientation comprise incorrect orientation.

3. A automated shotgun shell wad dispensing assembly as defined in claim in 1, which includes:

(a) A selector bar is present, (b) Said selector bar having a attached end and a free end, (c) A single selector bar is disposed inside each and every said collating plate cutout, (d) Said collating plate has said rotation in said clock wise direction as viewed from above, (e) Said clock wise direction defines said cutout as having a said leading edge and a said trailing edge, (f) Said selector bar is oriented so said attached end is attached to said collating plate said trailing edge, (g) Each and every said wad are further defined with inherent features to include a said base end of said first depth and a said cup end of said second depth greater than the said base end of said first depth, (h) Said wad taken up in said cutout said cup end up orientation comprise said correct orientation, (i) Said wad taken up in said cutout other than said cup end up orientation comprise said incorrect orientation, (j) Said selector bar providing interference in said collating plate said cutout allowing said wad in said incorrect orientation to be rejected by gravity due to said hopper said inclined relation given progression of said collating plate said rotation, (k) Said interference is excluded when said wad enters said cutout so that said selector bar goes inside said cup end of said second depth, (l) With said interference excluded a single said wad is retained in said cutout, (m) The said retained said wad in said cutout is in said correct orientation, (n) Said retained said wad in said cutout is delivered to said hopper said closed end said discharge opening by said collating plate said rotation.

4. A automated shotgun shell wad dispensing assembly as defined in claim 1, which includes:

(a) A rejector component is present, (b) Said rejector component as a interference means to reject said wad in said incorrect orientation not excluded by said collating plate said cutout said selector bar and gravity, (c) Said cylinder wall has a superior most point defined as 12 o'clock as viewed from above, (d) Said rejector component representing a spring mounted in said hopper inside and, (e) On the 10 o'clock location of said hopper said cylinder wall as viewed from above, (f) Said rejector component disposed above said collating plate.

5. A automated shotgun shell wad dispensing assembly as defined in claim 1, which includes:

(a) Said shotgun reloading machine has inherent function to receive said wad in said correct orientation into a wad carrier that positions said wad for incorporation into shotgun shell by the said shotgun reloading machine, (b) A wad feed tube is present, (c) Said wad feed tube made of transparent material, (d) Said wad feed tube entire length is defined as five segments of equal length, (e) Said wad feed tube further defined as having a upper segment of four said segments of said equal length, (f) Said wad feed tube further defined as having a lower segment of one said segment of said equal length, (g) Said wad feed tube said upper segment oriented in the vertical, (h) Said wad feed tube said lower segment angled and oriented to make obtuse angle to the said upper segment for directing said wad to said shotgun reloading machine said wad carrier, (i) Said wad feed tube has a upper end and lower end, (j) A funnel is disposed between said hopper said discharge opening and said upper end of said wad feed tube, (k) Said funnel providing said wad conveyance between said hopper said discharge opening and said wad feed tube said upper end under gravity, (l) Said wad feed tube for conveyance of said wad under gravity is disposed between said funnel and said shotgun reloading machine said wad carrier, (m) Said wad feed tube said upper segment additional function as buffer of wads received from said hopper discharge opening via funnel, (n) Said wad feed tube attached to said shotgun reloading machine by brackets, (o) Said wad feed tube having a upper bias clearance hole and a lower bias clearance hole, (p) Said upper bias clearance hole located above lower bias clearance hole, (q) Said upper bias clearance holes and said lower bias clearance hole both above said wad feed tube said lower segment, (r) Wad feed tube has a single optical clearance hole below said wad feed tube said upper end.

6. A automated shotgun shell wad dispensing assembly as defined in claim 1, which includes:

(a) A wad meter is present, (b) Said wad meter comprised of a single upper bias component and single lower bias component, (c) Said upper bias component located above said lower bias component, (d) Said upper bias component represented as pull type solenoid with a working shaft oriented perpendicular to said wad feed tube, (e) Said upper bias component attached with bracket to said wad feed tube, (f) Said lower bias component represented as pull type solenoid with a working shaft oriented perpendicular to said wad feed tube, (g) Said lower bias component attached with bracket to said wad feed tube, (h) Said upper bias component said working shaft disposed in line with said upper bias clearance hole of said wad feed tube, (i) Said lower bias component said working shaft disposed in line with said lower bias clearance hole of said wad feed tube, (j) Said upper bias components in rest state applies bias, (k) Said upper bias components in active state removes bias, (l) Said lower bias components in rest state applies bias, (m) Said lower bias components in active state removes bias, (n) Each and every said wad are further defined with inherent features to include possessing mid section of first width and base end of second width greater than said mid section of said first width, (o) Said upper bias component said working shaft to act via said upper bias clearance hole with said wad said mid section of said first width, (p) Said upper bias component in said rest state selecting and retaining a single said wad from said buffer of wad, (q) Said upper bias component said working shaft to act via said upper bias clearance hole with said wad said mid section of said first width, (r) Said upper bias component in said active state to release and deliver a single said wad under gravity to said lower bias component, (s) Said lower bias component said working shaft to act via said lower bias clearance hole with said wad said base end of said second width, (t) Said lower bias component in said rest state selecting and retaining a single said wad delivered under gravity by said upper bias component, (u) Said lower bias component said working shaft to act via lower bias clearance hole with said wad said base end of said second width, (v) Said lower bias component in said active state to release and deliver a single said wad under gravity via said wad feed tube said lower segment to said wad carrier.

7. A automated shotgun shell wad dispensing assembly as defined in claim 1, which includes:

(a) Said shotgun reloading machine has inherent function of a motion cycle defined with a mid-cycle and end-cycle as said shotgun reloading machine is manually actuated to perform a single cycle in a plurality of cycles in shotgun shell reloading, (b) Said shotgun reloading machine said motion cycle via mechanical linkage inherent in design of said shotgun reloading machine, (c) Progression by manual actuation of said reloading machine said motion cycle to said mid-cycle causes said mechanical linkage to move upwards, (d) Progression by manual actuation of said reloading machine said motion cycle to said end-cycle causes said mechanical linkage to move downwards, (e) Synchronization component is present, (f) Said synchronization component providing synchronization between said shotgun reloading machine and said wad meter, (g) Said synchronization component providing synchronization between said shotgun reloading machine and said wad meter by single upper synchronizing switch and single lower synchronizing switch, (h) Said upper synchronizing switch is in normal open state when not contacted by said shotgun reloading machine said mechanical linkage, (i) Said upper synchronizing switch is in closed state when contacted by said shotgun reloading machine said mechanical linkage, (j) Said lower synchronizing switch is in normal open state when not contacted on by said shotgun reloading machine said mechanical linkage, (k) Said lower synchronizing switch is in closed state when contacted by said shotgun reloading machine said mechanical linkage, (l) Said upper synchronizing switch in a series circuit with said wad meter said upper bias component and electrical power supply, (m) Said lower synchronizing switch in a series circuit with said wad meter said lower bias component and electrical power supply, (n) Said upper synchronizing switch attached by bracket to said shotgun reloading machine, (o) Said lower synchronizing switch attached by bracket to said shotgun reloading machine, (p) Upper synchronizing switch disposed above lower synchronizing switch, (q) Manual actuation of said shotgun reloading machine causes progression of said motion cycle to said mid-cycle, (r) Said shotgun reloading machine at said mid-cycle causes said mechanical linkage to contact and change said upper synchronizing switch to said closed state, (s) Said upper synchronizing switch in said closed state changes said upper bias component to said active state, (t) Said upper bias component in said active state releases said wad that was received by said upper bias component under gravity from said buffer of wads, (u) Further manual actuation of said shotgun reloading machine causes progression of said motion cycle to said end-cycle, (v) Said shotgun reloading machine at said end-cycle causes said mechanical linkage to contact and change said lower synchronizing switch to said closed state, (w) Said lower synchronizing switch in said closed state changes said lower bias component to said active state, (x) Said lower bias component in said active state releases said wad received by said lower bias component under gravity from said upper bias component, (y) Further manual actuation of said shotgun reloading machine causes progression of said motion cycle past said mid-cycle, (z) Said shotgun reloading machine past said mid-cycle causes said mechanical linkage to remove contact and change said upper synchronizing switch to said normal open state, (a') Said upper synchronizing switch in said normal open state changes said upper bias component to said rest state, (b') Said upper bias component in said rest state retains next said wad received by said upper bias component under gravity from said buffer of wads, (c') Further manual actuation of said shotgun reloading machine causes progression of said motion cycle past said end-cycle, (d') Said shotgun reloading machine past said end-cycle causes said mechanical linkage to remove contact and change said lower synchronizing switch to said normal open state, (e') Said lower synchronizing switch in said normal open state changes said lower bias component to said rest state, (f') Said lower bias component in said rest state retains next said wad received by said lower bias component under gravity from said upper bias component.

8. A automated shotgun shell wad dispensing assembly as defined in claim 1, which includes:

(a) A buffer switch is present, (b) Said buffer switch provides buffer over run prevention for said wad feed tube said additional function as said buffer of wads, (c) Said buffer switch is an optical switch, (d) Said optical switch in normal closed state, (e) Said optical switch is in series circuit with said gear reduction motor and electrical power supply, (f) Said optical switch is disposed in line with said wad feed tube said optical switch clearance hole such that an optical path present into said wad feed tube, (g) Said optical path is perpendicular to said wad feed tube, (h) Said optical switch mounted by bracket to said outside of said hopper said closed end, (i) Said wad feed tube said additional function as said buffer of wads is filled with supply of said wad from said hopper, (j) The said filled said buffer of wad causes interruption of said optical path changing said optical switch to open state (k) Said optical switch in said open state removes power to said gear reduction motor, (l) Said shotgun reloading machine manual actuation results in progression of said reloading machine motion cycle which causes depletion of said wad from said wad feed tube said additional function as said buffer of wad (m) Said optical path is cleared by said depletion with further manual actuation of said reloading machine, (n) Said depletion returns said optical switch to said normal closed state, (o) Said optical switch in said normal closed state restores power to said gear reduction motor.

* * * * *